US008282514B2

(12) United States Patent
Kapheim et al.

(10) Patent No.: US 8,282,514 B2
(45) Date of Patent: Oct. 9, 2012

(54) SPORTS RACQUET FOR IMPACTING A BALL AND FACILITATING THE OPENING OF A CAP ON A BOTTLE

(75) Inventors: Robert T. Kapheim, Elmhurst, IL (US); Scott M. Doyle, Oak Park, IL (US); William D. Severa, Darien, IL (US)

(73) Assignee: Wilson Sporting Goods Co., Chicago, IL (US)

( * ) Notice: Subject to any disclaimer, the term of this patent is extended or adjusted under 35 U.S.C. 154(b) by 150 days.

(21) Appl. No.: 13/014,495

(22) Filed: Jan. 26, 2011

(65) Prior Publication Data

US 2012/0190487 A1 Jul. 26, 2012

(51) Int. Cl.
*A63B 49/08* (2006.01)

(52) U.S. Cl. ..... 473/549; 473/524; 473/553

(58) Field of Classification Search ..... 473/553, 473/549, 524; 81/3.09; 7/151
See application file for complete search history.

(56) References Cited

U.S. PATENT DOCUMENTS

| | | | | | |
|---|---|---|---|---|---|
| 1,739,457 | A | | 12/1929 | Harrison | |
| 1,810,630 | A | * | 6/1931 | Tapp | 81/3.09 |
| 2,296,404 | A | | 6/1942 | Ressegger | 30/123 |
| 2,608,889 | A | * | 9/1952 | Krupin | 81/3.09 |
| 4,361,920 | A | | 12/1982 | Zanni | 7/151 |
| 4,560,344 | A | | 12/1985 | Kietaibl | 431/253 |
| 4,642,827 | A | | 2/1987 | Karuzas | 7/151 |
| 4,768,403 | A | | 9/1988 | Bar-Noy | 81/3.15 |
| D373,290 | S | * | 9/1996 | Ballin | D7/536 |
| 5,642,882 | A | * | 7/1997 | Guerzini | 473/549 |
| D395,384 | S | | 6/1998 | Farfalli | D8/38 |
| 5,797,814 | A | * | 8/1998 | Janes et al. | 473/551 |
| D408,236 | S | | 4/1999 | Rennick | D8/38 |
| 6,086,489 | A | * | 7/2000 | Hsu | 473/549 |
| 6,089,996 | A | * | 7/2000 | Hsu | 473/523 |
| D435,412 | S | | 12/2000 | Bentley | D8/38 |
| 6,159,115 | A | * | 12/2000 | Hsu | 473/549 |
| 6,185,772 | B1 | | 2/2001 | Bates | 7/151 |
| 6,289,542 | B1 | | 9/2001 | Dignam | 7/151 |
| 6,544,030 | B1 | | 4/2003 | Evers | 431/253 |
| D479,966 | S | * | 9/2003 | Falt et al. | D8/38 |
| D480,284 | S | * | 10/2003 | Falt et al. | D8/38 |
| D486,045 | S | * | 2/2004 | Falt et al. | D8/38 |
| 6,775,869 | B2 | | 8/2004 | Cohen | 7/151 |
| 7,237,292 | B1 | | 7/2007 | Endres | 7/151 |
| 7,284,284 | B2 | | 10/2007 | Wysopal | 2/209.13 |
| 7,367,670 | B2 | | 5/2008 | Duane | 351/158 |
| 7,614,321 | B2 | | 11/2009 | Cohen | 81/3.09 |
| 7,617,748 | B1 | | 11/2009 | Chenelia | 81/3.55 |
| 7,658,130 | B1 | | 2/2010 | Porteous | 81/3.09 |
| 7,673,357 | B1 | | 3/2010 | Stump et al. | 7/151 |
| D621,675 | S | | 8/2010 | Molina | D8/38 |
| 2002/0072438 | A1 | * | 6/2002 | Boxer | 473/553 |
| 2005/0035080 | A1 | * | 2/2005 | Romero | 215/228 |
| 2009/0133537 | A1 | * | 5/2009 | Uglum | 81/3.37 |
| 2012/0190487 | A1 | * | 7/2012 | Kapheim et al. | 473/549 |

* cited by examiner

*Primary Examiner* — Raleigh W. Chiu
(74) *Attorney, Agent, or Firm* — Terence P. O'Brien

(57) ABSTRACT

A sports racquet for impacting a game ball and for facilitating the opening of a cap on a bottle. The sports racquet includes a head portion and a handle portion. The handle portion has a proximal end and a distal end. The distal end is coupled to the head portion. The proximal end defines a recess, and includes a projection spaced apart from a fulcrum. The recess is sized to removably receive a portion of the cap. The projection is configured to catch a portion of an underside of the cap and the fulcrum is configured to bear against the top of the cap as one or both of the handle portion and the bottle serve as a lever for prying the cap off of the bottle.

21 Claims, 4 Drawing Sheets

SPORTS RACQUET FOR IMPACTING A BALL AND FACILITATING THE OPENING OF A CAP ON A BOTTLE

FIELD OF THE INVENTION

The present invention relates generally to a sports racquet. In particular, the present invention relates to sports racquet configured for impacting a ball and for facilitating the opening of a cap on a bottle.

BACKGROUND OF THE INVENTION

Sport racquets or paddles, such as platform tennis racquets, paddle tennis racquets, padel tennis racquets, tennis racquets, table tennis paddles, badminton racquets, racquetball racquets and squash racquets, are well known and enjoyed by users in many recreational activities. Platform tennis is an American racquet sport invented in 1928 in New York, and enjoyed by thousands of people of all ages. It is the only racquet sport that is frequently enjoyed outdoors in cold weather. This unique appeal attracts people who desire fresh air, competition, and social engagement. The game is typically played on an elevated aluminum deck on a court that is smaller than a tennis court. The deck or base of the court is usually enclosed allowing for a heating system to be positioned beneath the deck. The court is surrounded by a 12 foot high, taut wire fencing which allows play off the walls, as in racquetball and squash.

Paddle tennis, which also originated in New York, has existed for over a hundred years. Paddle tennis is a game derived from tennis and played on court that is smaller than a conventional tennis court. Paddle tennis courts are constructed in a manner similar to tennis courts, and can also exist on hard beach sand. Unlike platform tennis, paddle tennis does not require fencing positioned about the court. Paddle tennis is played with a depressurized tennis ball and an underhand serve. The smaller court size adds a strong emphasis and advantage to net play and creates a fast and reaction-based game.

Padel tennis (or just pádel) is a racquet sport similar to paddle tennis. It was invented in Acapulco, Mexico in 1969 and played extensively in Spain and Latin America. The court is about half the size of a tennis court and includes walls, which like platform tennis are in play.

Sports racquets for platform tennis, paddle tennis and padel tennis are constructed with a rigid rounded planar head portion connected to a handle portion. The head portion is unstrung and typically includes aerodynamic holes extending therethrough. Other sports racquets, such as tennis racquets, badminton racquets, racquetball racquets and squash racquets generally include a head portion that forms closed curved structure supporting a matrix of string segments (also referred to as a string bed). A handle portion is typically coupled to the head portion.

Many racquet sports are engaged in as part of a social gathering. Such social gatherings provide participants the opportunity to play the racquet sport and to enjoy the company of the other participants. During such social sports activities, it is common for the participants to take breaks, or to rotate in and out of play, to partake in and to enjoy beverages and other refreshments with other participants. During the colder months, platform tennis players will frequent warming huts or break areas to allow players to warm themselves and also to enjoy beverages and other refreshments.

During such events, it is common for players to enjoy bottled beverages. Many bottled beverages are secured with metal bottle caps that are pleated or ruffled around the upper rim of the bottle. Such bottles typically require a bottle opener or other tool to remove the cap from the bottle. Bottle opening tools are small devices that are easily misplaced, lost or forgotten. Accordingly, on many occasions, players engaging in social racquet sporting events can find themselves without a tool for removing caps from the bottles of beverages. Accordingly, a need exists for a convenient way to ensure that players at social racquet sporting events do not find themselves without a device or tool for removing the caps from beverage bottles. It would be advantageous to provide a mechanism for ensuring that a social sporting event can be held with refreshments without having to remember to bring, carry or obtain a tool for removing a cap from a beverage bottle.

SUMMARY OF THE INVENTION

The present invention provides a sports racquet for impacting a game ball and for facilitating the opening of a cap on a bottle. The sports racquet includes a head portion and a handle portion. The handle portion has a proximal end and a distal end. The distal end is coupled to the head portion. The proximal end defines a recess, and includes a projection spaced apart from a fulcrum. The recess is sized to removably receive a portion of the cap. The projection is configured to catch a portion of an underside of the cap and the fulcrum is configured to bear against the top of the cap as one or both of the handle portion and the bottle serve as a lever for prying the cap off of the bottle.

According to a principal aspect of a preferred form of the invention, a butt cap is configured for attachment to a handle portion of a sports racquet and for facilitating the removal of a cap from a bottle. The butt cap includes a body having a distal region and a proximal region. The distal and proximal regions define first and second opposing recesses, respectively. The first recess is sized to receive a proximal end of the handle portion of the sports racquet. The second recess is sized to removably receive at least a portion of the cap. The proximal region includes a projection and a fulcrum. The projection is configured to engage a portion of an underside of the cap and is spaced apart from the fulcrum. The fulcrum is configured to operably engage the top of the cap as one or both of the handle portion and the bottle serve as a lever for prying the cap off of the bottle.

According to another preferred aspect of the invention, a sports racquet for impacting a game ball and for facilitating the opening of a cap on a bottle includes a rigid head portion, a handle portion and a butt cap. The head portion includes opposing first and second planar surfaces. The head portion defines a plurality of holes perpendicularly extending from the first surface through to the second surface. The holes are configured to allow for air to flow through the head portion while the racquet is swung to impact the ball. The handle portion has a proximal end and a distal end. The distal end is coupled to the head portion, and the butt cap is coupled to the proximal end of the handle portion. The butt cap defines an open recess, and includes a projection spaced apart from a fulcrum. The recess is sized to removably receive a portion of the cap. The projection is configured to catch a portion of an underside of the cap and the fulcrum is configured to bear against the top of the cap as one or both of the handle portion and the bottle serve as a lever for prying the cap off of the bottle.

This invention will become more fully understood from the following detailed description, taken in conjunction with the accompanying drawings described herein below, and wherein like reference numerals refer to like parts.

DETAILED DESCRIPTION OF THE PREFERRED EMBODIMENTS

Figure 1:
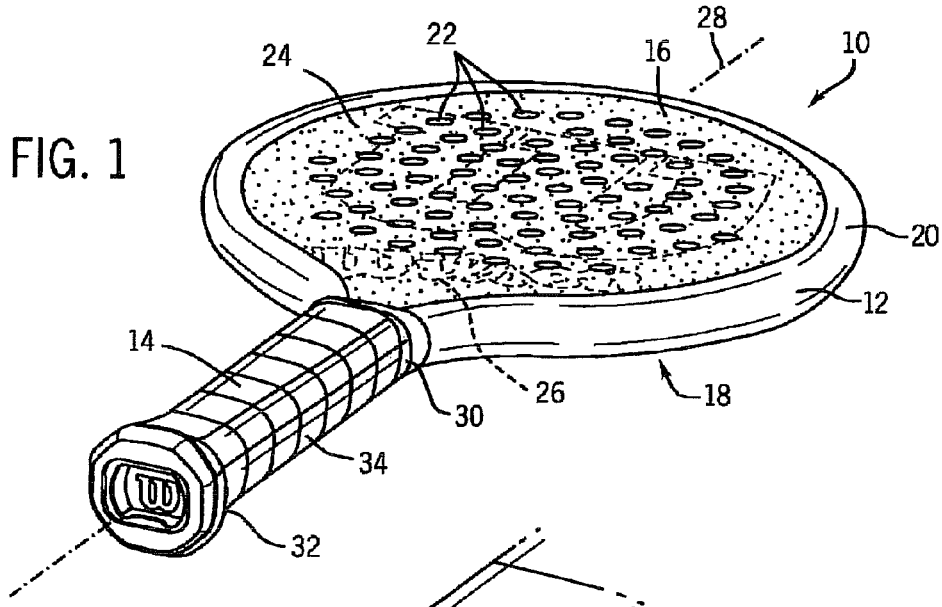
FIG. 1 is a front, end perspective view of a sports racquet in accordance with a preferred embodiment of the present invention.

Referring to FIG. 1, a sports racquet is indicated generally at 10. The racquet 10 of FIG. 1 is configured as a platform tennis racquet, however, the invention can also be formed as other types of sports racquets, such as, for example, a paddle tennis racquet, a padel tennis racquet, a tennis racquet, a table tennis paddle, a badminton racquet, a racquetball racquet, and a squash racquet. The platform tennis racquet 10 has a construction that is similar to the construction of a paddle tennis racquet and a padel tennis racquet. The characteristics of the platform tennis racquet 10 discussed below are directly applicable to paddle tennis racquets and padel tennis racquets.

In a preferred embodiment, the racquet 10 a length of approximately 18 inches, a maximum width of approximately 9.5 inches, and a weight of approximately 13.2 ounces. In other preferred embodiments, the racquet can be formed of other dimensions and weights. The racquet 10 includes a head portion 12 coupled to a handle portion 14. The head portion 12 is a rigid planar structure configured for impacting a game ball. The head portion 12 includes first and second opposing planar surfaces 16 and 18 and an edging 20. In a preferred embodiment, the head portion 12 has a thickness measured from the first planar surface 16 to the second planar surface 18 of approximately 0.7 inches. In alternative preferred embodiments, the head portion can be formed of other thicknesses. The head portion 12 preferably includes a plurality of holes 22 perpendicularly extending from the first planar surface 16 to the second planar surface 18. The holes 22 are spaced apart from each other and facilitate the swinging of the racquet 10 by enabling air to flow through the head portion 12 during use. In one particularly preferred embodiment, the head portion 12 can include 87 holes, each with a diameter of approximately 0.375 inch. In alternative preferred embodiments, other numbers and sizes of holes can be used.

The first and second planar surfaces 16 and 18 can include a roughened texture 24. The roughened texture 24 can be formed by sand or other particles applied to, or positioned under one or more coatings applied to, the first and second planar surfaces 16 and 18. Alternatively, the roughened texture 24 can result from a surface treatment performed on the first and second planar surfaces 16 and 18. The roughened texture 24 enhances a player's ability to impart a spin or otherwise control the motion of the ball during impact with the head portion 12. In an alternative preferred embodiment, the first and second planar surfaces can be smooth and not roughened or textured. The first and second planar surfaces 16 and 18 can also include alpha-numeric and/or graphical indicia 26. The indicia 26 can include one or more of the following items: trademarks, logos, symbols, patterns, designs, instructions, racquet design characteristics, advertisements, playing rules, warnings and combinations thereof.

The edging 20 preferably extends about the periphery of the head portion 12 between the first and second planar surfaces 16 and 18. The edging 20 can be integrally formed as part of the head portion 12 or can be applied to the head portion 12 as a separate structure. The edging 20 can have a thickness (or width) that is equal to the thickness of the head portion 12 measured from the first planar surface 16 to the second planar surface 18. Alternatively, thickness of the edging 20 can extend approximately 0.125 inch beyond the first planar surface 16 and the second planar surface 18. The edging can also overlap or extend over a portion of the first and second planar surfaces 16 and 18 by 0.5 inch or less from the periphery of the head portion 12. The edging 20 is preferably formed of a tough, durable material, such as, a thermoplastic. Alpha-numeric and/or graphical indicia can also be applied to the outer surface of the edging. Alternatively, the edging 20 can be formed of other durable materials, such as for example, other plastic materials, a rubber, a thermoset material, a fiber composite material, a metallic alloy, wood and combinations thereof. The edging 20 can provide a flat, convex or concave contour to the side or periphery of the head portion 12.

The head portion 12 can be formed of one or more materials preferably a carbon-fiber composite material surrounding a foamed material. As used herein, the term "composite material" refers to a plurality of fibers impregnated (or permeated throughout) with a resin. The fibers can be co-axially aligned in sheets or layers, braided or weaved in sheets or layers, and/or chopped and randomly dispersed in one or more layers. The composite material may be formed of a single layer or multiple layers comprising a matrix of fibers impregnated with resin. In multiple layer constructions, the fibers can be aligned in different directions with respect to a longitudinal axis 28 of the racquet 10, and/or in braids or weaves from layer to layer. The fibers are formed of a high tensile strength material such as carbon. Alternatively, the fibers can be formed of other materials such as, for example, glass, graphite, boron, basalt, carrot, flax, Kevlar®, Spectra®, poly-para-phenylene-2, 6-benzobisoxazole (PBO), hemp and combinations thereof. In one set of preferred embodiments, the resin is preferably a thermosetting resin such as epoxy or polyester resins. In other sets of preferred embodiments, the resin can be a thermoplastic resin. The composite material is typically wrapped about a mandrel and/or a comparable structure, and cured under heat and/or pressure. While curing, the resin is configured to flow and fully disperse and impregnate the matrix of fibers. In alternative embodiments, the head portion 12 can be formed of other materials such as, for example, a thermoset material, a thermoplastic material, aluminum, other metals, wood, and combinations thereof. The foam material can be an open or closed cell material formed of ethylene vinyl acetate (EVA). Alternatively, other foamed materials can be used such as for example, polyurethane, rubber, polyethylene, other lightweight elastic foams, and combinations thereof.

The handle portion 14 is a longitudinal tubular structure having a distal and proximal end 30 and 32. The distal end 30 of the handle portion 14 is coupled to the head portion 12. In one preferred embodiment, the handle portion 14 can be integrally formed with and connected to the head portion 12 to form a one piece frame. In an alternative preferred embodiment, the handle portion 14 can be formed separate from and coupled to the distal end 30 of the handle portion 14. The handle portion 14 is configured for grasping by one or more hands of a user during play. The handle portion 14 can be formed of one or more materials such as a carbon-fiber composite material. Alternatively, the handle portion 14 can be formed of other materials such as other composite materials, aluminum, other metallic alloys, wood, a polyurethane foam, a thermoplastic material, a thermoset material and combinations thereof. The handle portion 14 can include a grip 34 to enhance the ability of a player to grasp, hold and manipulate the racquet 10.

Referring to FIGS. 2*a* through 2*d*, other forms of sports racquets are illustrated including a tennis racquet 100, a squash racquet 200, a badminton racquet 300 and a racquetball racquet 400. The present invention is directly applicable to each of these racquets. The racquets 100 through 400 each include a head portion 112, 212, 312 and 412 coupled to a handle portion 114, 214, 314 and 414. The head portion 112, 212, 312, and 412 is preferably a tubular structure shaped to define a hoop. The hoop can be any closed curved shape including, for example, a generally oval shape, a generally tear-drop shape, a generally pear shape, a generally circular shape and combinations thereof. The head portion 112, 212, 312 and 412 preferably includes a plurality of string holes for supporting a string bed 116, 216, 316 and 416 configured for impacting a game ball.

Figure 3:
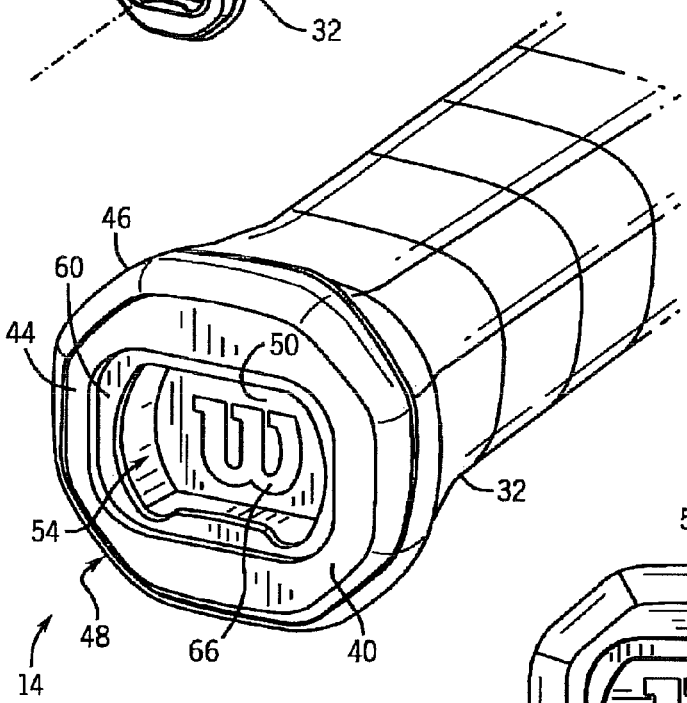
FIG. 3 is an enlarged front, end perspective view of a handle portion of the racquet of FIG. 1.
Figure 4:
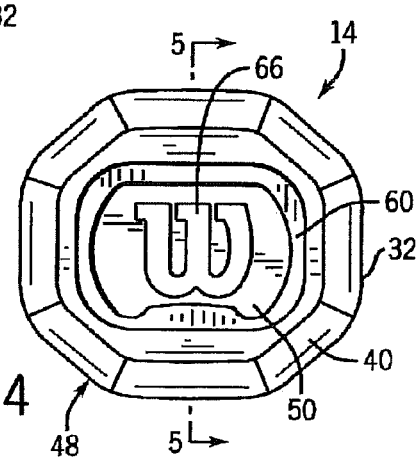
FIG. 4 is an end view of the handle portion of the racquet of FIG. 1.
Figure 2A:
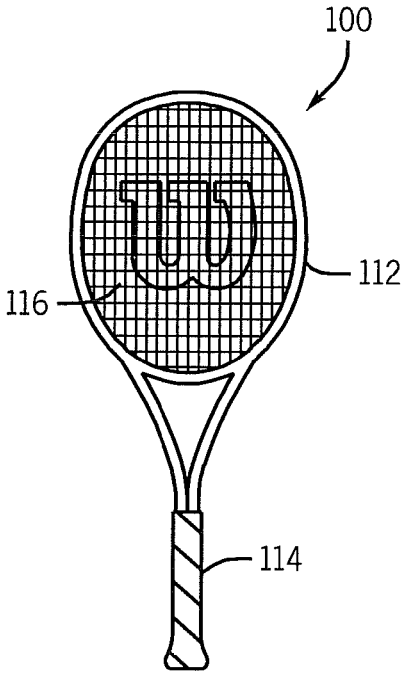
FIGS. 2*a* through 2*d* are front views of other forms of sports racquets in accordance with a preferred embodiment of the present invention.
Figure 2B:
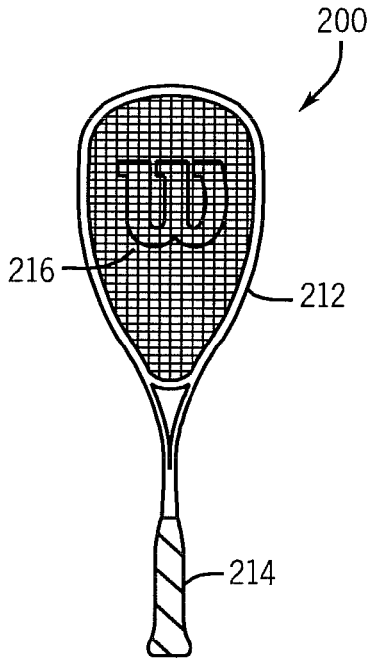
Figure 2C:
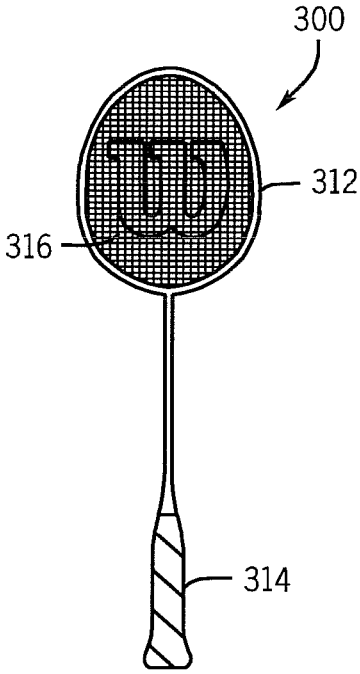
Figure 2D:
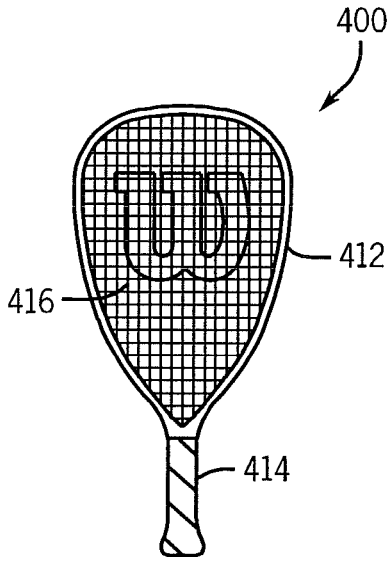
Figure 5:
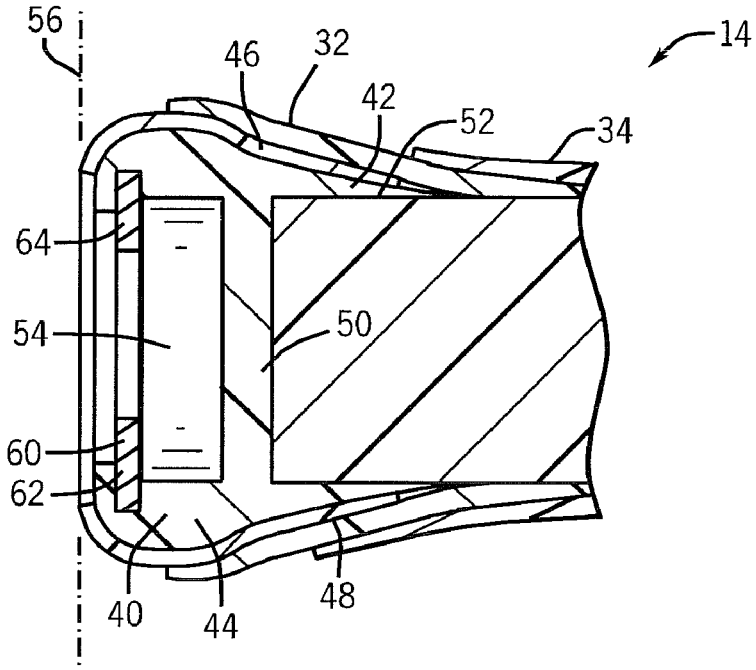
FIG. 5 is a longitudinal, cross-sectional view of a proximal end of the handle portion of the racquet taken about line 5-5 of FIG. 4.

Referring to FIGS. 3 through 5, the proximal end 32 of the handle portion 14 is illustrated. A butt cap 40 can be coupled to the proximal end 32. In one preferred embodiment, the butt cap 40 can be directly adhesively bonded to the proximal end 32. Alternatively, the butt cap can be thermally bonded, mechanically fastened, or otherwise directly attached to the proximal end. In another alternative embodiment, the butt cap can be coupled to the proximal end by an intermediate member or layer of material. The proximal end 32 of the handle portion 14, and the description of the invention of FIGS. 3-7, is also directly applicable to the handle portions 114, 214, 314 and 414.

The butt cap 40 includes a body having a distal region 42 and a proximal region 44. The butt cap 40 includes peripheral wall 46 longitudinally extending about a portion of the proximal end 32 of the handle portion 14. The peripheral wall 46 preferably forms a generally octagonal shaped outer surface including eight generally planar portions 48. The octagonal shaped outer surface and planar portions 48 correspond to flats defined into the outer surface of the handle portion 14 for facilitating proper grip positioning for players. In alternative preferred embodiments, the outer surface of the butt cap can take other shapes, such as, other cylindrical shapes, other tubular shapes and other elongate polygonal shapes. The butt cap 40 further includes an end wall 50 that extends perpendicular to the longitudinal axis 28 of the racquet 10. The end wall 50 at least partially covers the termination of the proximal end 32 of the handle portion 14. Referring to FIG. 5, in one preferred embodiment, the end wall 50 entirely covers the termination of the proximal end 32. The distal and proximal regions 42 and 44 of the butt cap 40, and the peripheral and end walls 46 and 50, define first and second recesses 52 and 54. The first recess 52 is sized and shaped to receive at least a portion of the proximal end 32 of the handle portion 14. The proximal region 44 preferably terminates at a plane 56 (FIG. 5). The second recess 54 extends inwardly and longitudinally from the plane 56.

The proximal region 44 includes a rim 60 formed about at least a portion of the peripheral wall 46. In one preferred embodiment, the rim 60 extends 360 degrees about the peripheral wall 46. In other embodiments, the rim 60 can extend over a portion or portions of the peripheral wall. The rim 60 can be integrally formed as part of the proximal region 44 or can be formed as a separate component that is fixedly secured to the proximal region 44. The rim 60 includes a projection 62 and a fulcrum 64 spaced apart from the projection 62. The projection 62 preferably projects toward the fulcrum 64 and extends over or into the second recess 54. The projection 62 and/or the fulcrum 64 are preferably formed of a hard material, preferably a metallic alloy. Alternatively, the projection and/or the fulcrum can be formed of other materials, such as, for example, a fiber composite material, aluminum, a thermoplastic material, a thermoset material, a ceramic or combinations thereof.

Referring to FIGS. 3 and 4, the end wall 50 can include alpha-numeric and/or graphical indicia 66. The indicia 66 can include one or more of the following items: trademarks, logos, symbols, patterns, designs, instructions, racquet design characteristics, advertisements, playing rules, warnings and combinations thereof.

Figure 6:
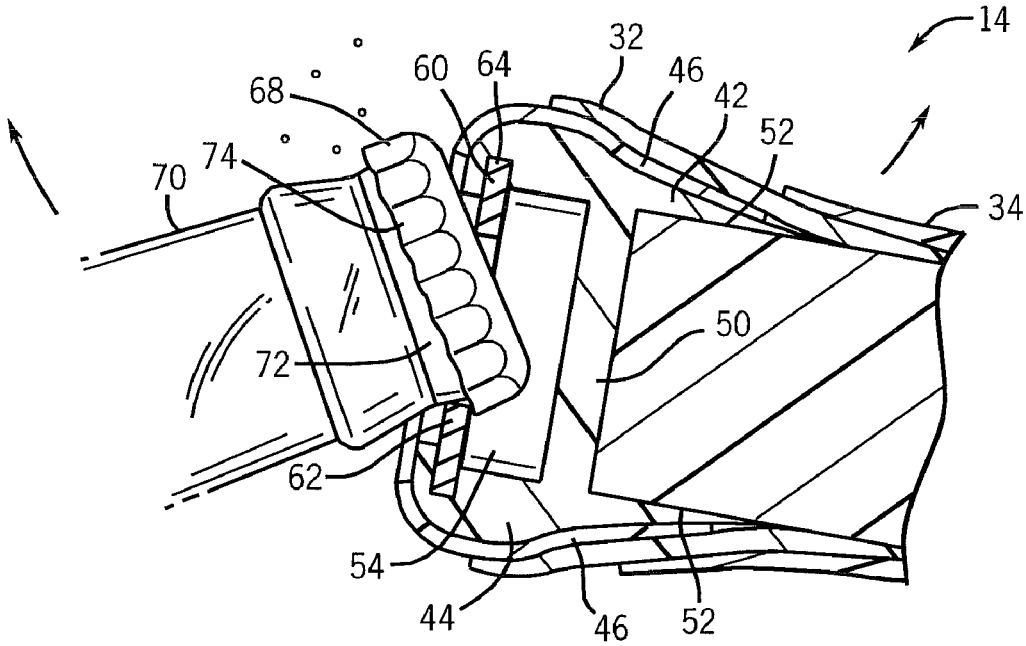
FIG. 6 is a longitudinal, cross-sectional view of a proximal end of the handle portion of the racquet of FIG. 1 operably engaging a cap on a bottle.

Referring to FIG. 6, the second recess 54 is configured to receive at least a portion of a cap 68 of a bottle 70. The cap 68 is typically formed of metal and covers an opening formed in the top of the bottle 70. The cap 68 is typically affixed about a bottle rim 72 by means of pleating 74. Once a portion of the cap 68 is inserted within the second recess 54 of the butt cap 40, the projection 62 is configured to contact, catch or otherwise operably engage an under side of the cap 68 below the pleating 74. The fulcrum 64 is configured to operably engage the top of the cap 68 when a user uses the bottle 70 and/or the handle portion 14 of the racquet 10 as one or more levers to pry the cap 68 off of the bottle rim 72 of the bottle 70. The bottle 70 and/or the handle portion 14 can be used by the user as a lever or levers to provide mechanical advantage to remove the cap 68 from the bottle 70. The fulcrum 64 bears against, and enables a force to be applied to, the top of the cap 68 thereby providing a pivot location for the cap 68 relative to the bottle 70. The projection 62 and fulcrum 64 enable the handle portion 14 of the racquet 10 to be used to quickly, efficiently and effectively remove a cap from a bottle.

Figure 7:
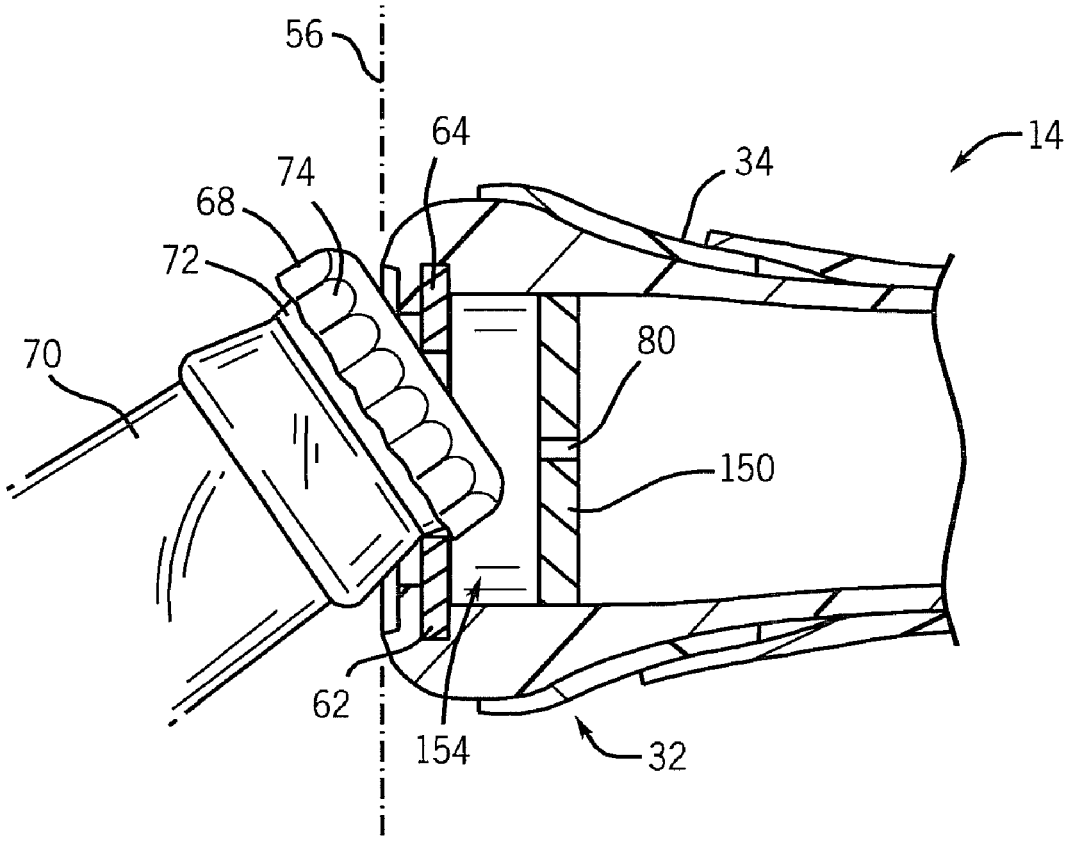
FIG. 7 is a longitudinal, cross-sectional view of a proximal end of a handle portion of a racquet in accordance with an alternative preferred embodiment of the present invention.

Referring to FIG. 7, in an alternative preferred embodiment, the racquet 10 can be formed without a butt cap. The proximal end 32 can terminate at the plane 56 and the proximal end 32 can define a recess 154 that inwardly and longitudinally extends into the proximal end 32 of the handle portion 14. The projection 62 and the fulcrum 64 can be integrally formed with or fixedly secured to the proximal end 32 of the handle portion 14. An end wall 150 can be inserted into and attached to the proximal end 32. Alternatively, the end wall 150 can be integrally formed as part of the proximal end 32 of the handle portion 14. An opening 80 can be formed within the end wall 150. In another alternative preferred embodiment, the proximal end of the racquet can be formed without a butt cap and/or with an end wall. The recess 154, like the second recess 54, is configured to receive a portion of the cap 68. The projection 62 is configured to contact, catch or otherwise operably engage an under side of the cap 68 below the pleating 74. The fulcrum 64 is configured to operably engage the top of the cap 68 when a user uses the bottle 70 and/or the handle portion 14 of the racquet 10 as one or more levers to pry the cap 68 off of the bottle rim 72 of the bottle 70. The bottle 70 and/or the handle portion 14 can be used by the user to a lever or levers to provide mechanical advantage to remove the cap 68 from the bottle 70. The fulcrum 64 bears against, and enables a force to be applied to, the top of the cap 68 thereby providing a pivot location for the cap 68 relative to the bottle 70.

The incorporation of the present invention improves a user's ability to enjoy racquet sports and the social gatherings commonly associated with the recreational play of racquet sports. The present invention enables a user to play the racquet sports and also be equipped to remove caps from bottles during social gatherings associated with the racquet sports activity. The present invention makes racquet sports and their accompanying social events simpler and more efficient. The application of the rim, the projection and the fulcrum to the proximal end and/or the butt cap of a sports racquet does not negatively affect the operation, use or play of the racquet. In some embodiments of the present invention, the addition of the projection and the fulcrum can be used to improve or optimize the moment of inertia of the sports racquet for certain players or applications. Further, the addition of the projection 62 and the fulcrum 64 can also improve swing weight of some racquet embodiments further improving the playability of such racquets.

While the preferred embodiments of the present invention have been described and illustrated, numerous departures therefrom can be contemplated by persons skilled in the art. Therefore, the present invention is not limited to the foregoing description but only by the scope and spirit of the appended claims.

What is claimed is:

1. A sports racquet for impacting a game ball and for facilitating the opening of a cap on a bottle, the racquet comprising:

a head portion; and a handle portion having a proximal end and a distal end, the distal end coupled to the head portion, the proximal end defining a recess, and including a projection spaced apart from a fulcrum, the recess being sized to removably receive a portion of the cap, the projection configured to catch a portion of an underside of the cap and the fulcrum configured to bear against the top of the cap as one or both of the handle portion and the bottle serve as a lever for prying the cap off of the bottle.

2. The sports racquet of claim 1, wherein the handle portion further includes a grip.

3. The sports racquet of claim 1, wherein the handle portion includes a butt cap, wherein the butt cap forms the proximal end of the handle portion, and wherein the butt cap defines the recess and includes the projection and the fulcrum.

4. The sports racquet of claim 3, the butt cap includes an end wall, and wherein the end wall includes alpha-numeric and/or graphical indicia.

5. The sports racquet of claim 4, wherein the indicia is selected from the group consisting of a trademark, a design, a pattern, an instruction, an advertisement, and combinations thereof.

6. The sports racquet of claim 4, wherein the butt cap further includes a peripheral wall and a rim.

7. The sports racquet of claim 6, wherein the end wall and the peripheral wall define the recess, wherein the projection extends from the rim, and wherein the fulcrum is formed by a portion of the rim.

8. The sports racquet of claim 1, wherein the sports racquet is selected from the group consisting of a platform tennis racquet, a paddle tennis racquet, a padel tennis racquet, a tennis racquet, a table tennis paddle, a badminton racquet, a racquetball racquet, and a squash racquet.

9. The sports racquet of claim 1, wherein the head portion is a generally rigid member having opposing first and second planar surfaces, and wherein the head portion defines a plurality of holes extending from the first surface to the second surface.

10. The sports racquet of claim 1, wherein the head portion is a generally rigid member having opposing first and second planar surfaces, and wherein the first and second planar surfaces are roughened.

11. A butt cap for attachment to a handle portion of a sports racquet, the butt cap configured for facilitating the removal of a cap from a bottle, the butt cap comprising:

a body including a distal region and a proximal region, the distal and proximal regions defining first and second opposing recesses, respectively, the first recess sized to receive a proximal end of the handle portion of the sports racquet, the second recess sized to removably receive at least a portion of the cap, the proximal region including a projection and a fulcrum, the projection being configured to engage a portion of an underside of the cap and being spaced apart from the fulcrum, the fulcrum configured to operably engage the top of the cap as one or both of the handle portion and the bottle serve as a lever for prying the cap off of the bottle.

12. The butt cap of claim 11, wherein the proximal region of the body includes a rim, and wherein the projection and the fulcrum are formed by the rim.

13. The butt cap of claim 12, wherein the rim is fixedly secured to the peripheral wall.

14. The butt cap of claim 12, wherein the rim is integrally formed with the peripheral wall.

15. The butt cap of claim 11, wherein the body further includes a peripheral wall and an end wall.

16. The butt cap of claim 15, wherein the end wall defines at least a portion of a first bottom of the first recess and at least a portion of a second bottom of the second recess.

17. The butt cap of claim 15 wherein the peripheral wall has a generally octagonal shaped outer surface that includes eight generally planar portions.

18. The butt cap of claim 15, wherein the end wall includes alpha-numeric and/or graphical indicia, and wherein the indicia is selected from the group consisting of a trademark, a design, a pattern, an instruction, an advertisement, and combinations thereof.

19. A sports racquet for impacting a game ball and for facilitating the opening of a cap on a bottle, the racquet comprising:

a rigid head portion including opposing first and second planar surfaces, the head portion defining a plurality of holes perpendicularly extending from the first surface through to the second surface, the holes configured to allow for air to flow through the head portion while swing the racquet to impact the ball;

a handle portion having a proximal end and a distal end, the distal end coupled to the head portion; and a butt cap coupled to the proximal end of the handle portion, the butt cap defining an open recess, and including a projection spaced apart from a fulcrum, the recess being sized to removably receive a portion of the cap, the projection configured to catch a portion of an underside of the cap and the fulcrum configured to bear against the top of the cap as one or both of the handle portion and the bottle serve as a lever for prying the cap off of the bottle.

20. The sports racquet of claim 19, wherein the head portion is substantially solid and not hollow, and wherein the racquet has a length of approximately 18 inches.

21. The sports racquet of claim 19, wherein the first and second planar surfaces are roughened.

* * * * *